United States Patent [19]

Reither

[11] Patent Number: 4,913,621

[45] Date of Patent: Apr. 3, 1990

[54] CENTRIFUGAL FAN

[75] Inventor: Karl Reither, Troisdorf-Spich, Fed. Rep. of Germany

[73] Assignee: Kt Kunststofftechnik GmbH, Troisdorf, Fed. Rep. of Germany

[21] Appl. No.: 739,125

[22] Filed: May 29, 1985

[30] Foreign Application Priority Data

May 29, 1985 [DE] Fed. Rep. of Germany ... 8416413[U]

[51] Int. Cl.[4] ..... F04D 29/44

[52] U.S. Cl. ..... 415/215.1; 415/212.1; 415/211.1

[58] Field of Search ..... 415/204, 206, 219 C, 415/211, 208, 182, 205, 203, 219 R, 211.1, 212.1, 215.1

[56] References Cited

U.S. PATENT DOCUMENTS

| | | | |
|---|---|---|---|
| 3,561,906 | 2/1971 | Fermer | 415/219 C X |
| 3,797,961 | 3/1974 | Brechbuhl | 415/219 C X |
| 3,811,790 | 5/1974 | Mikulina et al. | 415/206 X |
| 3,924,963 | 12/1975 | Zerrer | 415/219 C X |
| 4,073,597 | 2/1978 | Barnhart et al. | 415/219 C X |
| 4,213,742 | 7/1980 | Henshaw | 415/219 C X |

FOREIGN PATENT DOCUMENTS

| | | | |
|---|---|---|---|
| 2300040 | 9/1973 | Fed. Rep. of Germany | 415/219 C |
| 2342698 | 3/1975 | Fed. Rep. of Germany | 415/219 C |
| 1234767 | 10/1960 | France | 415/219 C |

*Primary Examiner*—Everette A. Powell, Jr.
*Attorney, Agent, or Firm*—Browdy and Neimark

[57] ABSTRACT

A centrifugal fan, comprising a housing with axially directed inlet and radially directed outlet as well as a driven impeller with rearwardly curved fan blades, the impeller being pivoted in the housing, includes a housing with an octogonal outer and inner cross section and further includes a sheet-metal deflector in the neighbourhood of the radial outlet, the deflector extending from one front wall to the other one and leading from the back edge of the outlet with respect to the rotational direction of the impeller radially inwards to the neighbourhood of the circumference of the impeller and from there outwards to the housing wall in a spiral-like curve. In a particular embodiment the impeller is displaced by a certain amount with respect to the center of the housing.

5 Claims, 2 Drawing Sheets

Fig.1
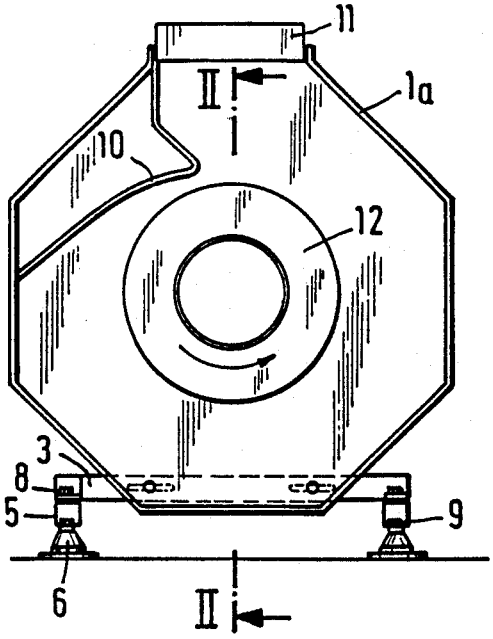
Fig.2
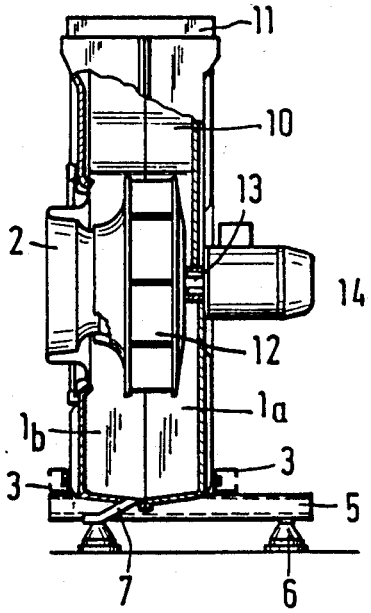
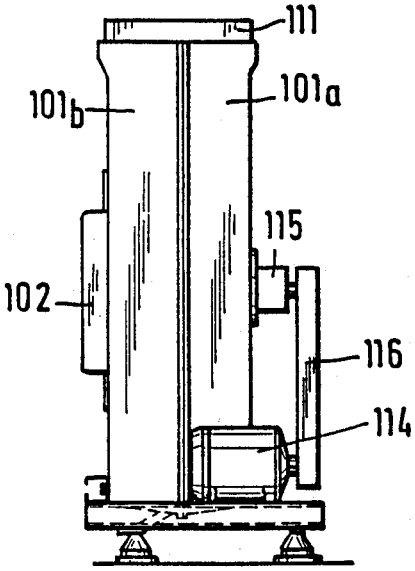
Fig.3

CENTRIFUGAL FAN

FIELD OF THE INVENTION

The invention relates to a radial or centrifugal fan or blower comprising a housing with an inlet and an outlet which is essentially perpendicularly directed with respect to said inlet, an impeller which is pivotably arranged in the housing and driven by a shaft pivoted in the housing, said impeller having backward curved blades, and a suction port opposite to the inlet of the housing.

BACKGROUND OF THE INVENTION

Fans of this kind are known and until now were constructed in such a way that the inside of the housing is shaped in a spiral form so that the end of the spiral with the greatest distance from the middle axis of the impeller is arranged in the neighbourhood of the outlet.

If the housing consists of a single thin wall, which of course reduces its costs of manufacturing from iron sheets, the outside of these centrifugal fans is also shaped in a spiral form.

These known centrifugal fans have the disadvantage that they cannot be mounted easily in an arbitrary position but rather require additional auxiliary means for this.

Accordingly, a known centrifugal fan, the housing of which is shaped in a spiral form from iron sheets, is provided for instance with rectangular walls or plates at its two front walls, said walls or plates standing out from the spiral shaped housing, and then can be mounted by means of these plates in more than one position. The mounting of the above-mentioned plates at the front sides of the known centrifugal fan however requires an increased amount of material and work which increases the price also.

The problem underlying the invention consists in manufacturing a centrifugal fan of the kind described at the very beginning in a simple and inexpensive way from iron sheets and thereby to provide a centrifugal fan not only with an inner form which is aerodynamically acceptable but also with an outer form which allows its mounting in different positions.

SUMMARY OF THE INVENTION

According to the invention this problem is solved by providing the housing with an octagonal outer and inner cross section, the inlet being arranged in the middle of one front wall which is preferred to be substantially flat, and the bearing of the impeller shaft being arranged substantially in the middle of the other opposite front wall. The outlet then lies in one of the octagonal sides of the housing, and the impeller has an outer diameter which is smaller than the diametral distance between two opposite octagonal sides of the housing. According to the invention a sheet-metal deflector is arranged in the interspace between the impeller and the housing, said deflector being placed by the side of the outlet and in rotational direction of the impeller towards the outlet and extending from one front wall to the other front wall. This sheetmetal deflector leads from the back edge of the outlet with respect to the rotational direction of the impeller substantially in radial direction inwards to the neighbourhood of the circumference of the impeller and from there substantially in a spiral form outwards to the housing wall.

Whereas the octagonal outer form of the housing is connected with essential advantages concerning the possibility of mounting the fan in different positions, the octagonal inner form, implied by the single wall construction of the housing from iron sheets, is aerodynamically absolutely satisfying. The inner angles between two neighbouring octagon sides (135°) which are, in the case of an octagon, relatively big anyway, have nearly no aerodynamic influence, since they are positioned at a certain distance from the circumference of the impeller. Appropriate values for the best choice of this distance may be obtained by a few simple tests. Thereby the rotational speed of the impeller as well as the geometric conditions of the fan blades as well as the desired characteristic properties of the centrifugal fan are more or less important determinants.

According to the invention a sheet-metal deflector is provided between the impeller and the housing behind the outlet in rotational direction of the impeller, extending from one front wall to the other, which deflects the air stream emerging from the impeller blades substantially in centrifugal direction and then forming a spiral and then circular flow-line pattern, and leads it to the outlet. According to the invention this sheet-metal deflector leads from the point where it comes closest to the impeller again outwards in a smooth spiral form to the housing wall.

On one hand it is easily possible to arrange the middle axis of the outlet tangentially to the circumference of the impeller as this is the case for the known centrifugal fans described in the beginning. On the other hand, in a preferred embodiment of the invention, one can obtain a symmetrical construction of the outlet if the middle axis of the outlet is arranged in such a way that it intersects the axis of the impeller.

Such a centrifugal fan with symmetrical outlet has considerable advantages concerning its installation and therefore can be used in a plurality of ways. In particular, the special version of a clockwise or counter-clockwise construction is avoided which otherwise is usual for spiral shaped housings.

Whereas it is sufficient to arrange the impeller in the middle of the octagonal housing, a further improvement of the air stream and hence of the efficiency of the centrifugal fan can still be achieved by a small displacement of the impeller with respect to the middle axis of the housing. A displacement between one fifth and one sixth of the diameter of the outlet opening is convenient, the displacement being performed in such a direction that the middle axis of the impeller lies on the side of the center line of the housing which is opposite to the opening of the outlet.

BRIEF DESCRIPTION OF DRAWING

The invention is described in detail hereinunder by means of embodiment with reference to the drawing. In the drawing it is shown by:

FIG. 1 an elevational view of the opened radial fan;

FIG. 2 a side elevational view partly cut along the line II-II in FIG. 1;

FIG. 3 a side elevational view of another embodiment and,

DETAILED DESCRIPTION OF EMBODIMENTS

Figure 4:
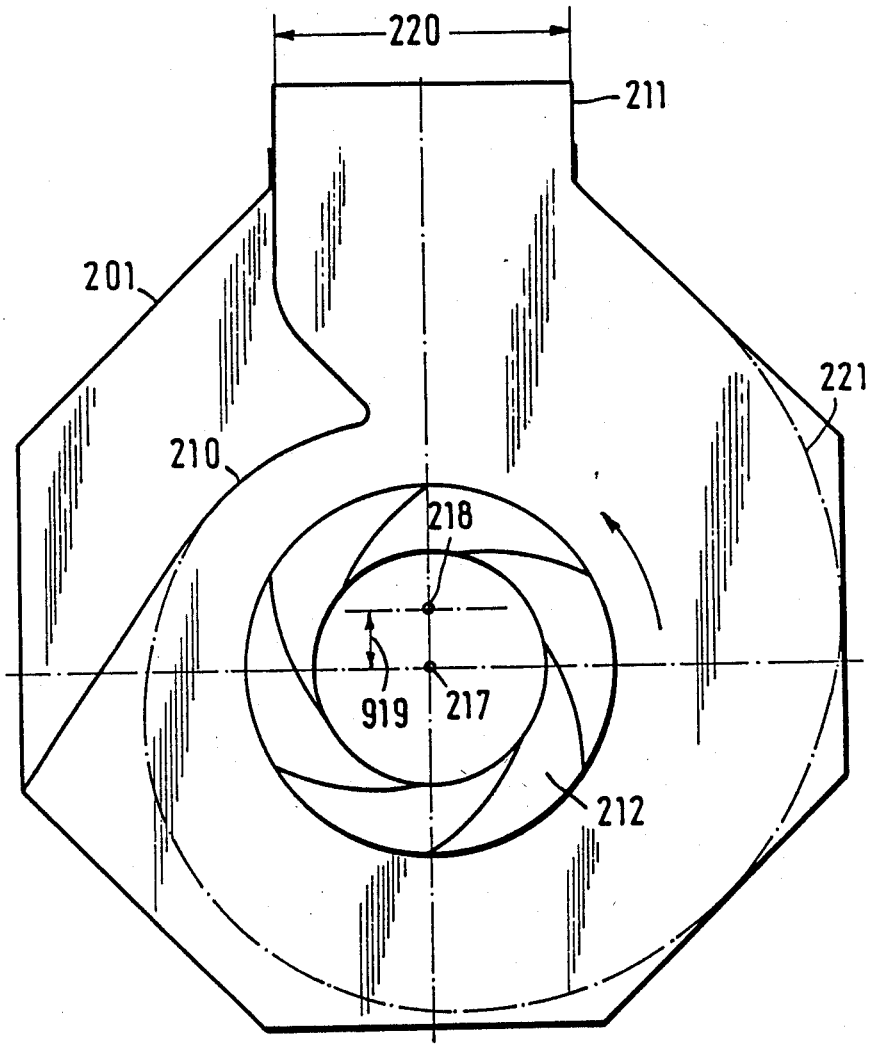
FIG. 4 an enlarged side elevational view, similar to FIG. 1, of an embodiment with an impeller which is displaced from the center of the housing.

The centrifugal fan which is shown in FIGS. 1 and 2 has a housing which consists of two half shells 1*a* and 1*b*. This housing is shaped in an octogonal form and has an outlet 11 which extends on both of the half shells.

In the center of one half shell 1b of the housing a circular opening is provided as inlet into which a ring 2 is inserted. This ring is formed in a funnel-shape and is tapered at its axial end lying inside of the housing. This end projects into a corresponding circular opening of the impeller 12, still to be described, without being in contact with it.

In the center of the other half shell 1*a* of the housing there is provided a bearing for the shaft 13 of said impeller 12 which by means of its rearwardly curved blades (as shown in FIG. 4) serves for deflecting the air stream, drawn in through inlet 2 in the axial direction, then radially towards the outside.

The shaft 13 of the impeller 12 is connected to the shaft of an electric motor 14 which is mounted on the half shell 1a of the housing. This motor drives the impeller, via an incorporated gearing, if necessary.

As is shown in FIG. 1, a sheet-metal deflector 10 is inserted into the housing which, departing from one edge of the outlet 11, leads substantially in the radial direction, however with a small bend in its middle, towards the circumference of the impeller and from there in a widely spaced bow or arc back to the octagonal housing wall. The impeller 12 is driven in the direction of the arrow in FIG. 1 and carries the air stream in circumferential direction, said air stream at first passing through the inlet 2 in axial direction and then flowing out at its circumference in a substantially radial direction. The air stream then is transported to the neighbourhood of the outlet 11 where it is prevented by the sheet-metal deflector 10 from a continuation of its circular movement so that finally the air stream passes through the outlet 11 in a substantially radial direction.

Because of the octogonal form of the housing, the centrifugal fan can be mounted in an arbitrary position. A mounting in one of its different possible positions is shown in FIGS. 1 and 2. Here two U-shaped bars 3 are arranged in parallel direction with respect to one octagonal side of the housing and close to the housing which are screwed or in another way attached to the housing. Beneath these bars and transversely to them there are U-shaped bars 5 which are attached to the bars 3 by means of screws 8.

By means of screws 9 the bars 5 are connected to vibration damping rubber feet 6 which can be placed on a solid base and attached to this base in a convenient way.

The alternate embodiment shown in FIG. 3 is also provided with a housing consisting of two half shells 101a and 101b with an annular inlet 102 and a similar outlet 111. In this embodiment the motor 114 is not directly flanged on the housing but rather connected to the shaft of the impeller (not shown in the drawing) via a corresponding bearing 115 and a drive belt 116.

In the embodiment shown in FIG. 4 the octagonal housing 201 with outlet 211 includes an impeller 212 which here, unlike the embodiment according to FIGS. 1 and 2, is displaced with respect to the central line 218 of the housing. The displacement of the central axis 217 of the impeller 212 is performed within the plane defined by the central line 218 of the housing and the center of the outlet 211, and is oriented in the direction opposite to the outlet 211. The displacement 219 preferably amounts to one fifth to one sixth of the diameter 220 of the outlet 211. It has been shown by means of tests that these values yield a particularly favourable flow-line pattern. For this embodiment also suitably formed sheet-metal deflector 210 is inserted into the housing.

As it is shown in FIG. 4 by the dash-dotted line, the walls of the octagonal housing, together with the deflector 210, approach this spiral form.

I claim:

1. A centrifugal fan, comprising a housing having a generally flat front wall with an inlet opening at substantially the center thereof, a back wall spaced from said front wall and defining therebetween the interior of said housing, and a side wall having eight sections providing said housing with an octagonal outer and inner cross-section, said housing having an outlet opening arranged in one of the eight sections of said octagonal side wall;

impeller means for sucking air through the inlet opening and for centrifugally driving such air along the interior of said housing and through the outlet, said impeller means including a rotatable impeller shaft extending through the back wall of said housing and an impeller supported and driven by said shaft and located in said housing, said impeller having fan blades for imparting radial flow to the air within said impeller and housing in a first rotational direction as said impeller rotates, said fan blades being curved rearwardly relative to said first rotational direction;

said outlet opening having an upstream edge and a downstream edge relative to said first rotational direction of radial flow of air; said impeller having an outer diameter which is smaller than the diametral distance between two opposite sections of said octagon side wall of the housing; and a deflector arranged within said housing downstream of said outlet opening between the interior of said housing and said impeller with a first wall extending generally radially inwards from said downstream edge of said outlet opening to the neighborhood of the circumference of said impeller and facing the air radially flowing in said first rotational direction, and a second wall extending from said first wall in said first rotational flow direction of the air to the inner side wall of said housing substantially in a spiral-like curve outwards to the housing side wall, said deflector extending from the front wall to the back wall.

2. A centrifugal fan according to claim 1 wherein said deflector is formed of sheet metal.

3. A centrifugal fan according to claim 1 wherein said first wall of said deflector is formed in two substantially straight parts comprising a first part extending from the downstream edge of said outlet towards said impeller and a second part extending at an obtuse angle from said first part in a direction opposite to the direction of radial air flow, said second part of said first wall being connected to said second wall of said deflector by an acute angle.

4. A centrifugal fan according to claim 1, characterized in that a displacement (219) exists between a center line (218) of the octagonal housing (201) and a middle axis (217) of the impeller (212), said displacement amounting to one fifth to one sixth of the diameter (220) of the outlet opening (211) of the housing.

5. A centrifugal fan according to claim 1 wherein said first wall of said deflector is curved from the downstream edge of said outlet opening first toward said impeller and then in a direction approaching a tangent to the circumference of said impeller in a direction opposite the direction of rotation of said impeller.

* * * * *